United States Patent [19]

Lopez-Martinez

[11] 4,213,220

[45] Jul. 22, 1980

[54] PROCESS FOR THE BINDING OF BOOKS, MAGAZINES AND THE LIKE

[76] Inventor: Luis J. A. Lopez-Martinez, 22B, c/Orense, Madrid 20, Spain

[21] Appl. No.: 954,239

[22] Filed: Oct. 24, 1978

[30] Foreign Application Priority Data

Nov. 4, 1977 [ES] Spain ..... 463.840

[51] Int. Cl.[2] ..... B42C 5/04; B42C 9/00

[52] U.S. Cl. ..... 11/1 R

[58] Field of Search ..... 11/1 AD, 1 R, 1 CP, 11/1 B

[56] References Cited

U.S. PATENT DOCUMENTS

| | | | |
|---|---|---|---|
| 3,179,967 | 4/1965 | Yohn et al. | 11/1 AD |
| 4,106,148 | 8/1978 | Axelrod | 11/1 AD |

FOREIGN PATENT DOCUMENTS

| | | | |
|---|---|---|---|
| 2325937 | 12/1974 | Fed. Rep. of Germany | 11/1 AD |

*Primary Examiner*—Paul A. Bell

*Attorney, Agent, or Firm*—Young & Thompson

[57] ABSTRACT

A process for the binding of books, magazines and the like, without the use of staples or sewing, comprises forming a plurality of spaced notched cuts along the central fold line of each page section to be bound, folding each page section along the central fold so that the notched cuts form a plurality of spaced projections, and gluing together the overlapping projections of adjacent pages. The notched cuts may be made to different levels so that the overlapping projections lie in a stepped formation.

6 Claims, 4 Drawing Figures

PROCESS FOR THE BINDING OF BOOKS, MAGAZINES AND THE LIKE

BACKGROUND OF THE INVENTION

The present invention concerns the binding of books, magazines, brochures and the like.

The known techniques for binding books, magazines and similar products, and for the manufacture of exercise books with blank pages ready for writing, employ metal staples or sewing with thread.

The present invention has for its object the provision of a new process for binding, in which this use of metal staples or sewing with thread is completely dispensed with. Another complementary object of the invention is to provide a book, magazine, brochure or exercise book produced by such a process.

Dispensing with the use of auxiliary elements, such as sewing threads and/or staples, provides the advantage of reducing expense appreciably, due to the lesser usage of materials, and also of reducing significantly the labour involved in manufacture.

Also, a book, magazine, brochure or exercise book, manufactured in accordance with the invention, provides a strong assembly, avoiding the risk of different sections or pages being able to come loose easily, as was frequently the case in the methods used hitherto.

SUMMARY OF THE INVENTION

Substantially, the process according to the invention consists in forming a series of cuts or notches on the folded line of each section of pages which must make up the whole of the book. These cuts or notches may be made in each page to a different level, from about ½ to 1 millimeter difference approximately, in such a way that, on the page sections being folded along the line of the central fold, a discontinuous series of projections sticks out slightly, in each one of which a small portion of each one of the pages which make up the page section remains visible, the projections being in the form of steps.

After joining together the page sections which must make up the totality of the book, magazine, or the like, the spine of the whole assembly presents an irregular surface, since the portions caused by these cuts stick out slightly, a lineal portion of each one of the pages which make up the book remaining visible.

Next, the general gluing of the spine of the book is carried out, utilising any appropriate glue, and with this operation each and every one of the page sections of the book remain perfectly joined, the joining being particularly strengthened on the portions which show parts of the base or folding line of each page to be in the form of steps, which make possible an efficacious and permanent fixing of the whole by the spine of the book.

DESCRIPTION OF THE PREFERRED EMBODIMENT

Figure 1:
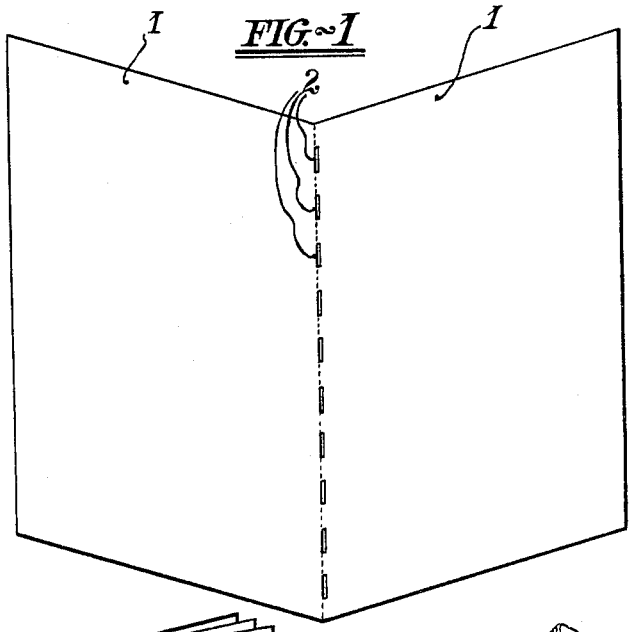
FIG. 1 is a view of an open page section on the central folding line of which discontinuous notched cuts have been made.
Figure 2:
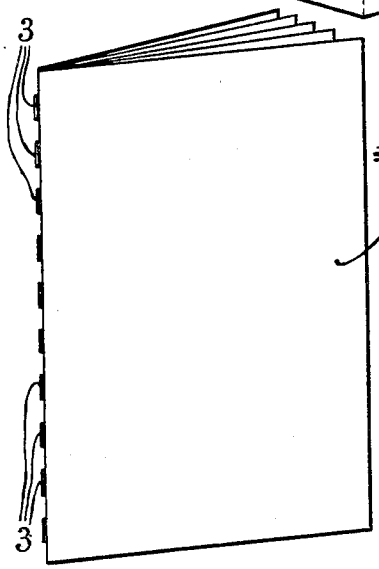
FIG. 2 shows the same page section folded in which the discontinuous projections can be seen which are formed by these notched cuts, in which some portions of all the pages which comprise this page section appear in the form of steps.
Figure 3:
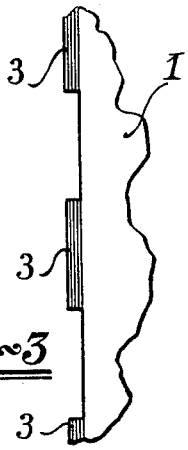
FIG. 3 is an enlarged view of the way in which these projections are arranged and the step formation of the pages.
Figure 4:
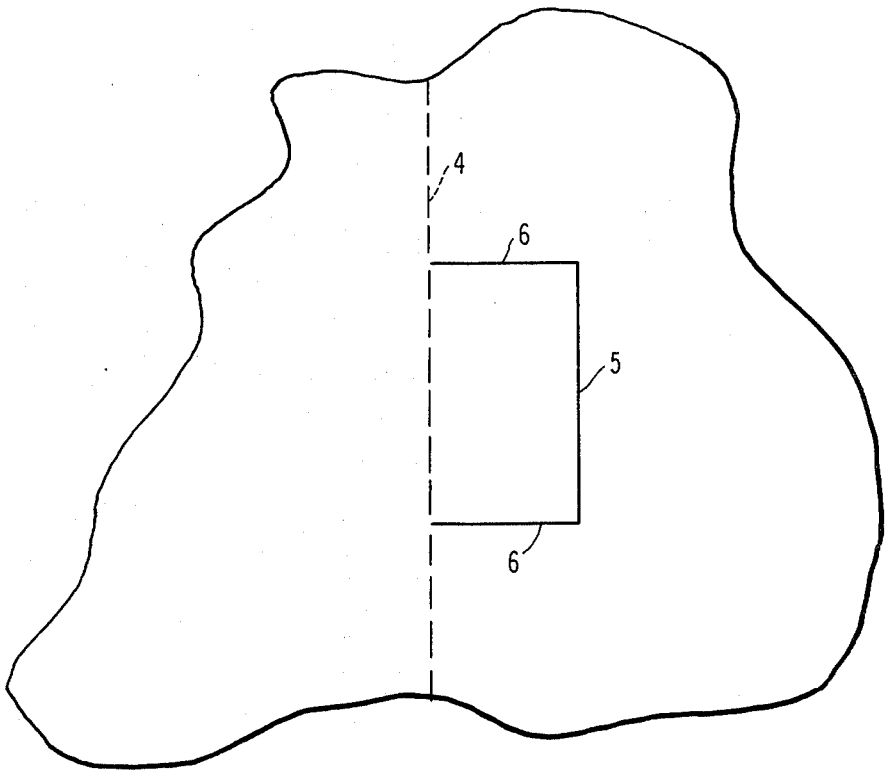
FIG. 4 is a fragmentary view of a page showing the fold line and notched cut prior to folding.

Referring to the drawings, the process of the invention consists essentially in making longitudinally a series of notched cuts 2 on each and every one of the page sections 1, which form the book, in the line of its central fold, in such a way that, on being folded to form the spine, some portions 3 of paper remain visible and slightly project from all or some of the pages which comprise the page section in question.

The notched cuts 2 may be spaced evenly apart along the length of the central fold 4. Each notched cut may comprise a straight portion 5 extending parallel to and spaced from the central fold, and end portions 6 extending at right angles from the ends of the straight portion up to the central fold. Thus, the portion of the page section defined between the central fold and each notched cut will stick out as a rectangular projection when the page section is folded along said central fold.

As is well known, each page section may be folded to form a plurality of pages of the completed book or magazine, and the notched cuts may be so positioned that when the page section is folded to form a set of pages, the pages are nested one within another and the projections on an inner page pass through the notches in each of the pages outwardly thereof so that the corresponding projections on adjacent pages overlap. The complete book may comprise a number of such sets of pages, each formed from a page section, arranged side by side.

Alternatively, each page section may be simply folded along its central fold line and a plurality of such page sections disposed side by side, or one nested within another, with the corresponding projections thereof overlapping.

In any of the above arrangements the notched cuts on adjacent pages may be cut to different depths, so that the projections are of different widths and overlap in a stepped formation. The difference in depth between adjacent notches may be from ½ to 1 millimeter.

In order to make the notched cuts mentioned, machines of special design are used, which are not shown, connected to the folding machine, the arrangement of the machine used depending on the type of paper, the number of pages of the page sections and the format of the page sections. Different types of notches may be formed, such as straight, spiked or oblique ones, with calculated partial breakages, and others, the type being chosen to provide the maximum strength of the book when glued.

Other known means can also be used for making the notched cuts, although the one previously mentioned is the one which is the most efficacious and convenient.

When the spine of the book is glued, the glue adheres to each and every one of the spines of the page sections which comprise it, especially in the projecting parts caused by the notched cuts, which improves the fixing conditions of all the pages, eliminating the use of threads, staples and other sewing methods used at present.

I claim:

1. A process for the binding of books, magazines and the like without the use of staples or sewing, comprising forming a plurality of spaced notched cuts along the central fold line of each page section to be bound, each notched cut extending to one side of the fold line, a projection portion comprising that portion of the page between the bottom of the notched cut and said central fold line, folding each page section along said central fold line so that said projection portions project from the fold line on the opposite side of the fold line from the notched cut, nesting the page sections one within another with the projection portions on an inner page passing through the notched cut in each of the pages outwardly thereof so that the corresponding projection portions on adjacent pages overlap, and gluing together the overlapping projection portions of adjacent pages.

2. A process according to claim 1 wherein the notched cuts are made in each of a plurality of adjacent pages to a different level so that when the projections of said adjacent pages overlap, a small portion of the face of each page is visible, the projections lying in a stepped formation.

3. A process according to claim 2 wherein the difference in level between the notched cuts of adjacent pages is from ½ to 1 millimeter.

4. A process according to claim 2 wherein said notched cuts are evenly spaced along the length of said central fold line.

5. A process according to claim 2 wherein said notched cuts have one side thereof substantially parallel to said central fold, so that each projection is substantially rectangular.

6. A book, magazine or the like formed by the process according to claim 2.

* * * * *